US006478165B1

(12) United States Patent
Noble

(10) Patent No.: US 6,478,165 B1
(45) Date of Patent: Nov. 12, 2002

(54) APPARATUS FOR DISPLAYING AND SECURING AN OBJECT SUCH AS A RIFLE

(76) Inventor: Richard A. Noble, 5214 Daytona Dr., Garland, Dallas County, TX (US) 75043

( * ) Notice: Subject to any disclaimer, the term of this patent is extended or adjusted under 35 U.S.C. 154(b) by 0 days.

(21) Appl. No.: 09/723,882

(22) Filed: Nov. 28, 2000

(51) Int. Cl.[7] ..... E05B 73/00
(52) U.S. Cl. ..... 211/4
(58) Field of Search ..... 211/4, 64

(56) References Cited

U.S. PATENT DOCUMENTS

| | | | | | |
|---|---|---|---|---|---|
| D173,773 | S | | 12/1954 | Westernacher | D80/9 |
| 2,958,423 | A | * | 11/1960 | Caloiero et al. | 211/64 |
| 3,180,494 | A | * | 4/1965 | Levy | 211/64 |
| 3,288,304 | A | * | 11/1966 | Graves | 211/64 |
| 3,291,317 | A | * | 12/1966 | Bowen | 211/64 |
| 3,643,811 | A | * | 2/1972 | Howerton | 211/4 |
| 3,964,613 | A | * | 6/1976 | Anderson, Jr. | 211/64 |
| 4,139,100 | A | * | 2/1979 | Reed | 211/4 |
| D288,154 | S | | 2/1987 | Hobgood | D6/466 |
| 4,998,944 | A | | 3/1991 | Lund | 42/94 |
| D413,365 | S | | 8/1999 | Kageyama et al. | D21/658 |
| 6,129,252 | A | | 10/2000 | Jackson et al. | 224/406 |
| 6,142,313 | A | | 11/2000 | Young | 211/4 |

* cited by examiner

*Primary Examiner*—Alvin Chin-Shue
*Assistant Examiner*—Sarah Purol
(74) *Attorney, Agent, or Firm*—Thompson & Gustavspn, L.L.P.

(57) ABSTRACT

A display (10) is provided for displaying an object such as a rifle (12). The object is not only displayed in an attractive manner, but can be secured to the display (10) to prevent casual removal of the object. Supports (38, 42) support the object while securing arms (72, 76) can be moved over the object to prevent casual removal of the object. The securing arms (72, 76) can be actuated by the actuating arm (80) positioned within a box (22) which can be locked to prevent access to the actuation arm (80). A safety block (40) can prevent the rifle safety from moving to the active position.

20 Claims, 6 Drawing Sheets

APPARATUS FOR DISPLAYING AND SECURING AN OBJECT SUCH AS A RIFLE

BACKGROUND OF THE INVENTION

Pride of ownership in an object, such as a well-made rifle, is often accompanied by the desire to display the object to allow the owner and others to admire the object. In the case of a rifle, it is important to provide a display which is capable of supporting the weight of the rifle, while revealing as much of the craftsmanship of the rifle as is possible. Also, with a rifle, safety concerns arise when unauthorized individuals, or children, might attempt to remove the rifle from the display.

A need exists for a high-quality, yet inexpensive display which is capable of displaying and securing an object against at least casual removal of the object.

SUMMARY OF THE INVENTION

In accordance with one aspect of the present invention, an apparatus is provided for displaying and securing an object from casual removal. The apparatus includes a frame, a first member extending from the frame defining a first support surface for the object and a second member extending from the frame defining a second support surface for the object. A securing member is mounted to the frame for movement between a first releasing positioned and a second securing position. The securing member in the second securing position interacts with the first member to secure the object therebetween against casual removal.

In accordance with another aspect of the present invention, the securing member is secured to an actuating arm. The actuating arm can be manually manipulated between a first releasing position and a second securing position. A locking mechanism can be provided to lock the actuating arm in the second securing position. The actuating arm and locking mechanism can be mounted within an enclosed structure.

BRIEF DESCRIPTION OF THE DRAWINGS

For a more complete understanding of the present invention and the advantages thereof, reference is now made to the following Detailed Description, taken in conjunction with the accompanying drawings, in which.

DETAILED DESCRIPTION

Figure 9:
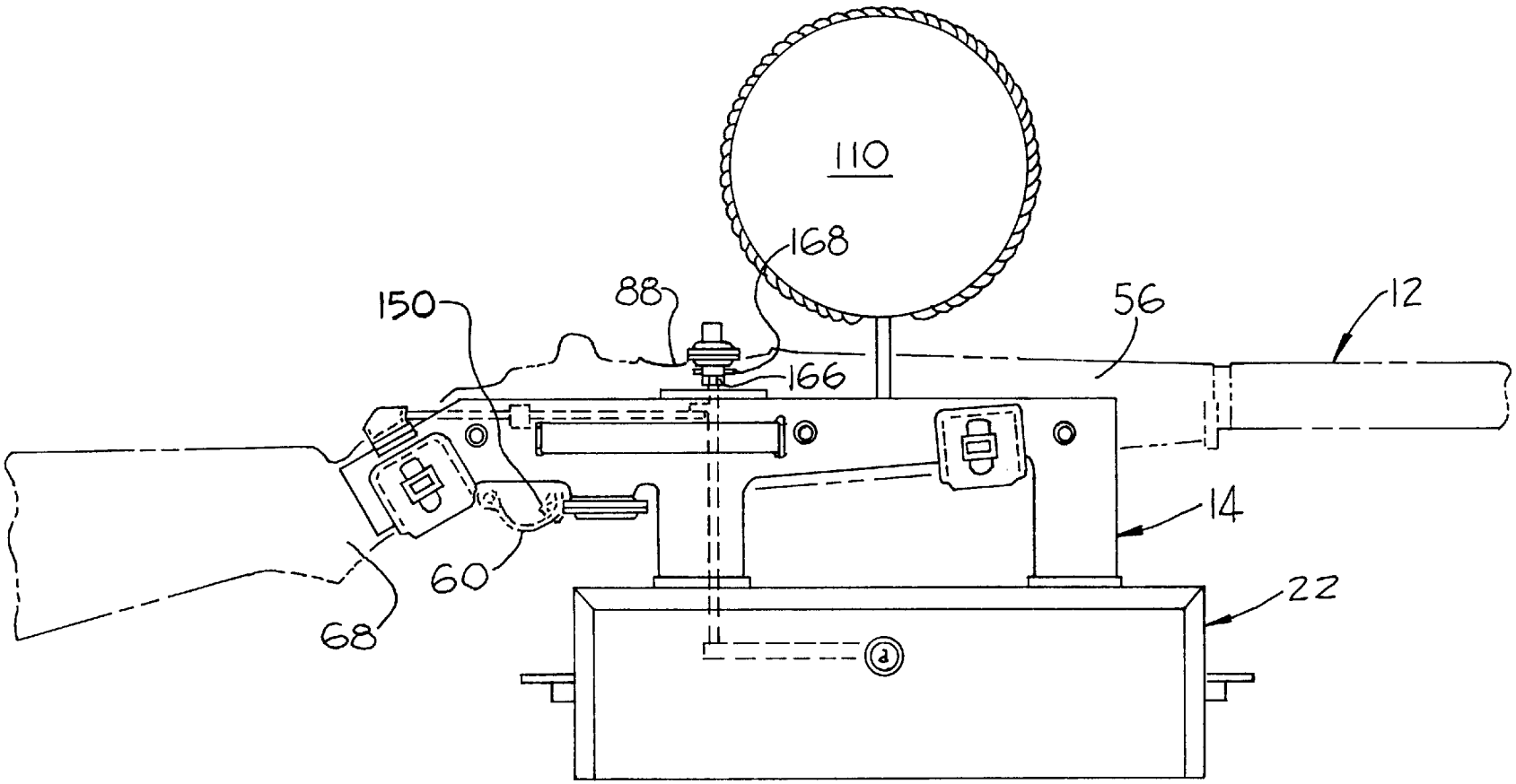
FIG. 9 is a front elevation view of the display with a rifle secured therein.

With reference now to the drawings, a display 10 forming a first embodiment of the present invention will be described. The display 10 is used to display an object, such as rifle 12, as seen in FIG. 9. In the Figure, the rifle is an M-1

Garand. However, it can hold any type of rifle, shotgun, pistol, or other firearm, as well as any other object, such as a sword, spear, etc. by simply altering the display as needed to fit the object. In addition, the display 10 provides for securing the object to the display to prevent casual removal of the object, as will be described in greater detail hereinafter. Typically, the display 10 would be mounted on the wall of a room. However, it could be mounted on any relatively flat surface, such as a table top or counter. When supported on a relatively horizontal surface, the display 10 need not be secured to the horizontal surface.

The display 10 can be seen to include a frame 14 formed of a relatively rigid material, such as wood, metal or a composite material. The frame has a generally elongate rectangular shape. The frame 14 also includes first and second legs 16 and 18 and an extension 20. The frame 14 is mounted on a box or container 22 at legs 16 and 18. The box 22 has a top 24, bottom 26, ends 28 and 30 and a back 32. A door 34 is hinged at one edge at the front of the box 22. The box 22 preferably is made to represent a military style foot locker to enhance the display of a military rifle. Alternatively, box 22 could look like an ammunition box or other ornamental enclosure with a shape that is related to the firearm being displayed.

Figure 1:
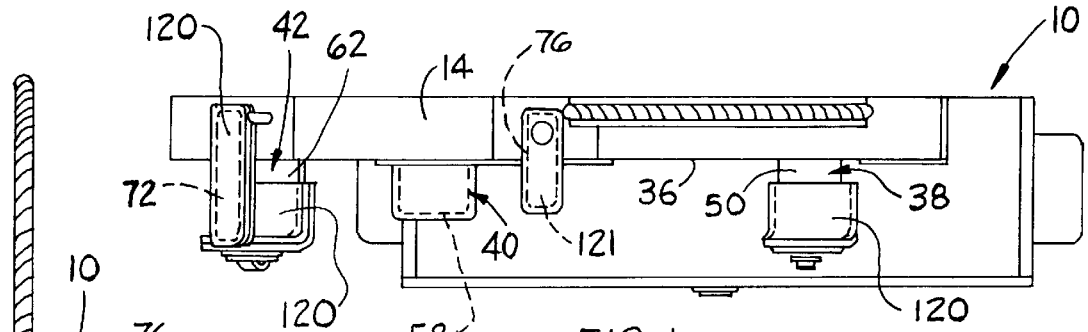
FIG. 1 is a plan view of a display forming a first embodiment of the present invention.
Figure 2:
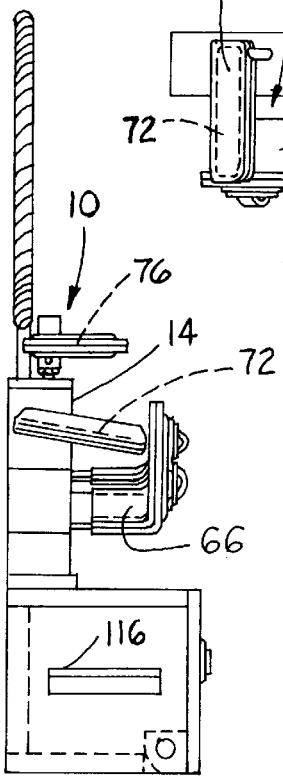
FIG. 2 is a left side elevation view of the display.
Figure 4:
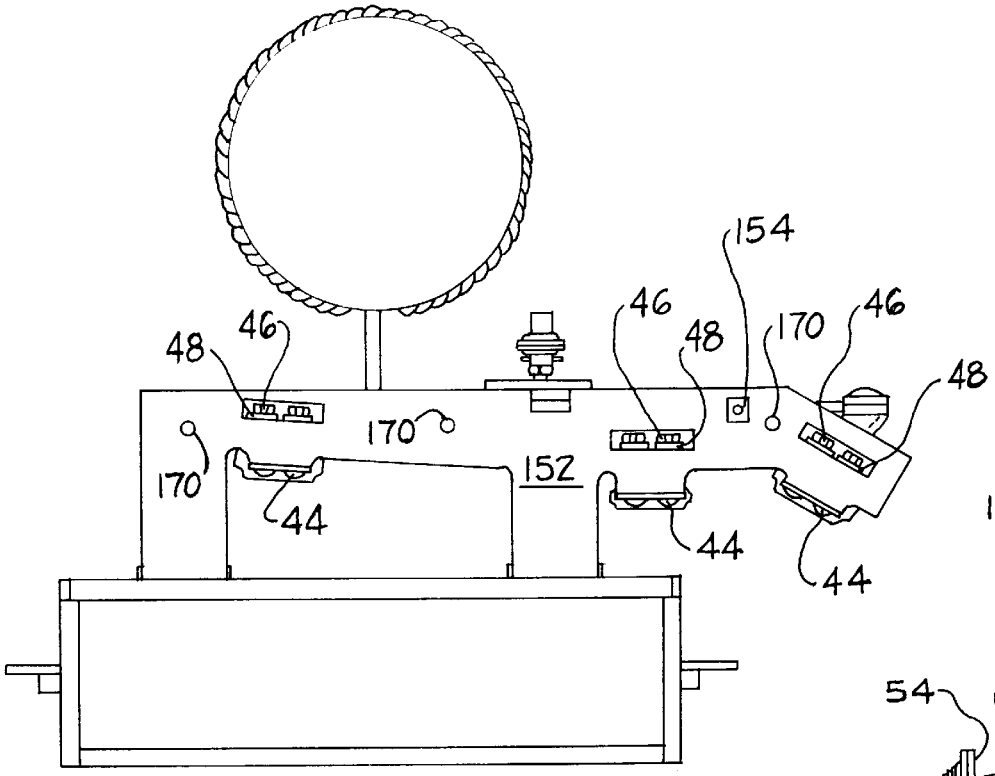
FIG. 4 is a rear elevation view of the display.
Figure 5:
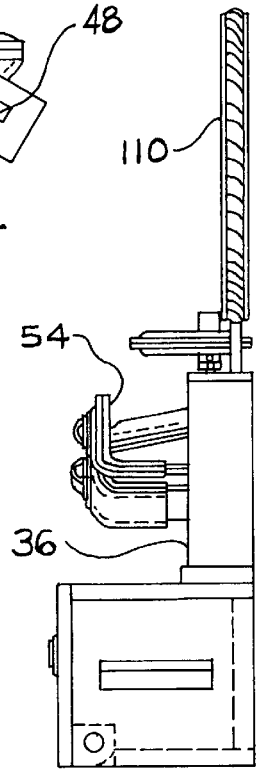
FIG. 5 is a right side elevation view of the display.
Figure 6:
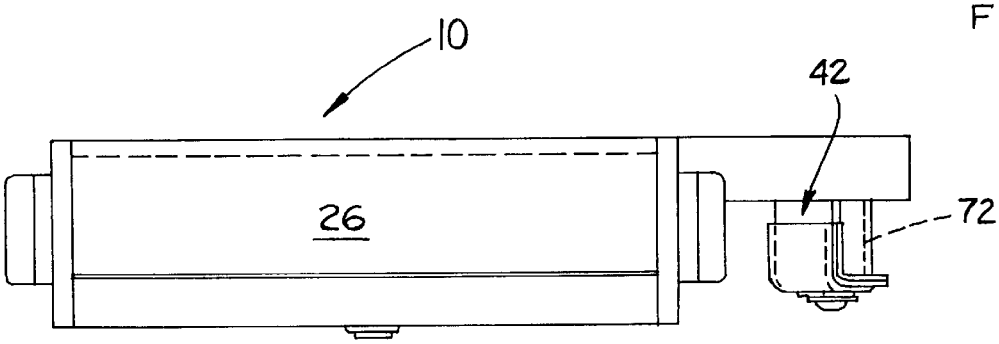
FIG. 6 is a bottom view of the display.

Frame 14 can be seen to define a planar surface 36. Mounted to the frame 14 and extending in front of the planar surface 36 are a series of supports 38 and 42. Support 38 is secured to the frame 14 between the first and second legs 16 and 18, preferably by carriage bolts 44, nuts 46 and lock washers 48 (FIG. 4). The support 38 includes a horizontal portion 50 extending generally outwardly from the surface 36 and a relatively vertical portion 52 extending generally parallel the surface 36. As can best be seen in FIGS. 2 and 5, the support 38 and planar surface 36 form a generally U-shaped interior surface 54 in which the rifle fore stock 56 can be supported. The support 42 is secured to the extension 20 of the frame 14, also by carriage bolts 44, nuts 46 and lock washers 48. The support 42 also has a horizontal portion 62 extending generally outwardly from and perpendicular to the surface 36 and a vertical portion 64 extending generally parallel the surface 36 to define a U-shaped surface 66 to support a portion of the stock 68 of the rifle 12.

A safety block 40 extends from the frame 14 between the first leg 16 and the extension 20. It is similarly mounted to the frame 14 by carriage bolts 44, nuts 46 and lock washers 48 (FIG. 4). Preferably, the safety block 40 has just a horizontal portion 58 extending generally perpendicular the surface 36 and is positioned immediately in front of the trigger guard 60 of the rifle and blocks the safety 150 of the rifle from moving to the forward, firing position while the rifle is supported on the display 10. Alternatively, or additionally, the safety block 40 could act as a support as well.

Figure 11:
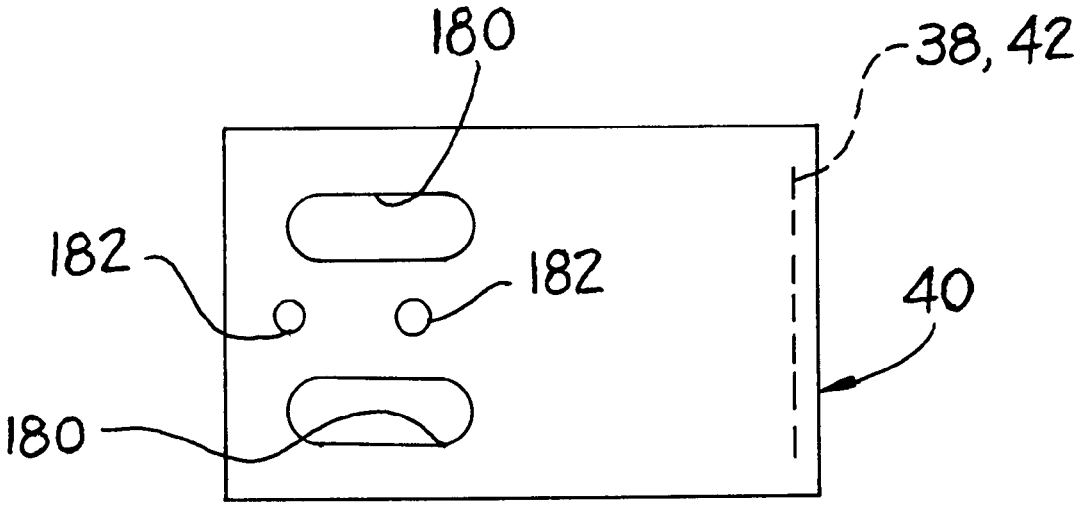
FIG. 11 is a detail view of the safety stop.

With reference to FIG. 11, additional details of the supports 38 and 42 and safety block 40 will be shown. The supports 38 and 42 and safety block 40 each have two elongated openings 180 for passage of the carriage bolts 44. By providing elongated openings 180, the position of each of the supports 38 and 42 and safety block 40 can be adjusted to fit the rifle before the carriage bolts 44 are tightened. Once the bolts 44 are tightened, the square shoulder under the head of the bolts 44 preferably limits the movement of the surrounding portion of the supports 38 and 42 and safety block 40 to essentially fix in place the proper adjustment. In addition, holes 182 can accept fasteners to fasten the supports 38 and 42 and safety block 40 to the frame 14 once they are properly positioned to more permanently secure their position to the frame 14. The fasteners can be nails, sheetmetal screws, pop rivets, molleys, etc. depending on materials utilized in construction of the frame 14 (mount).

As can be understood, the supports 38 and 42 will support the weight of the rifle 12. If this is the only object of display 10, no securing mechanism as described hereinafter would be necessary. However, it will typically be desirable to provide a securing mechanism 70 to secure the rifle 12 within the display 10 to prevent at least a casual removal of the rifle from the display. The securing mechanism 70 would not be intended to substitute for a firearm safe or other locking apparatus to protect a firearm from unauthorized use.

The securing mechanism 70 includes a stock securing arm 72 mounted at the end of a stock securing shaft 74. The securing mechanism 70 also includes a receiver securing arm 76 mounted at the end of a receiver securing shaft 78. An actuating arm 80 is secured at the end of the receiver securing shaft 78 opposite the receiver securing arm 76. A locking mechanism 82 can be used to lock the actuating arm 80 as will be described hereinafter.

Figure 8:
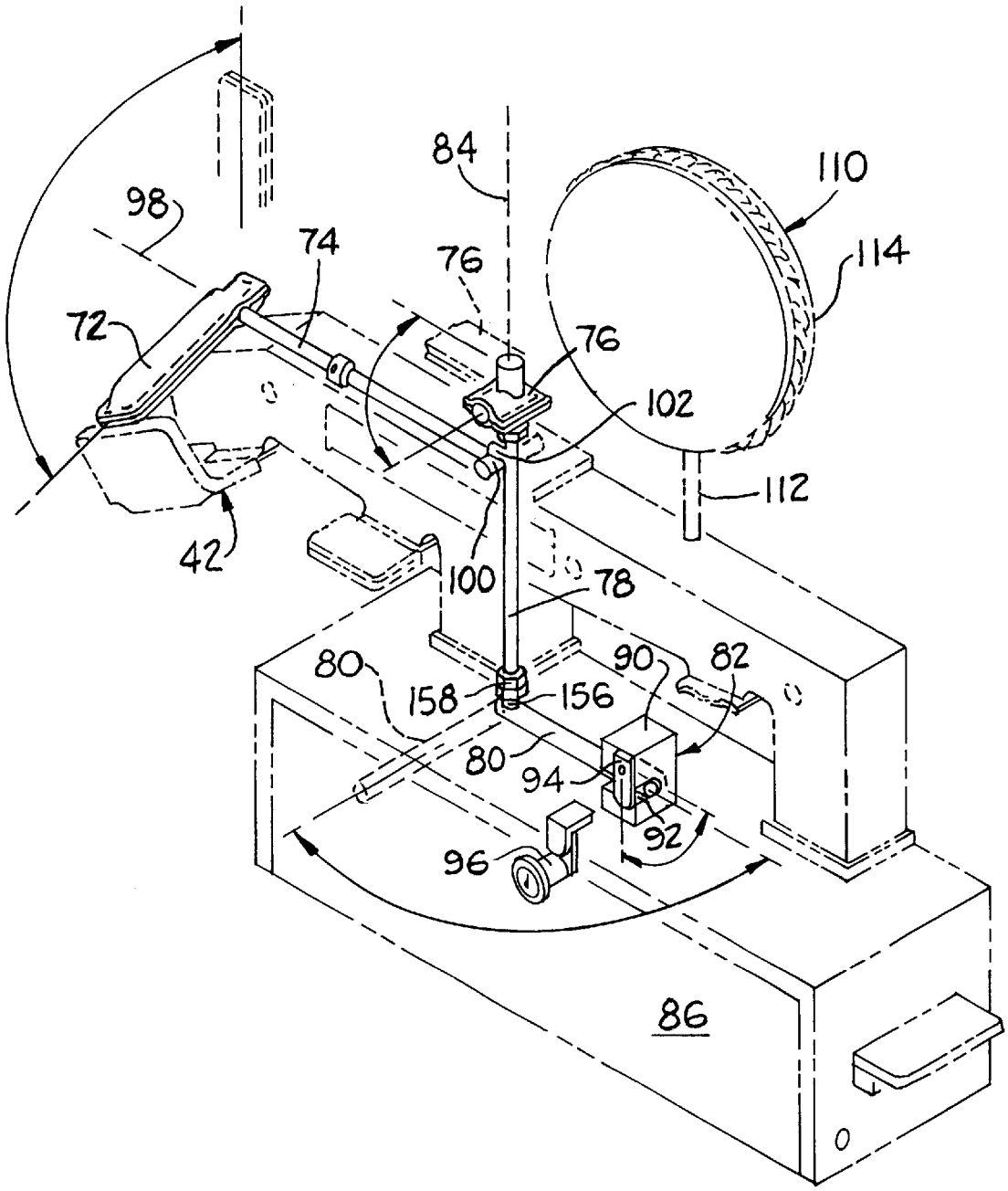
FIG. 8 is a perspective view of the display illustrating the lock mechanism.

The receiver securing shaft 78 is mounted within the frame 14 for pivotal motion about a generally vertical axis 84 and extends into the box 22 through leg 16. The actuating arm 80, which is secured to the lower end of the receiver securing shaft 78, is confirmed entirely within the interior 86 of the box 22. A person reaching their hand within the interior 86 can manipulate the actuating arm 80 from the position illustrated in dotted line in FIG. 8 to the position illustrated in solid line in FIG. 8 where the locking arm 80 can be secured in locking mechanism 82. As can be understood by reference to FIG. 8, when the actuating arm 80 is in the dotted line position in FIG. 8, the receiver securing shaft 78 is rotated about axis 84 so that the receiver securing arm 76 is generally parallel the length of the rifle 12 and lies above the frame 14, as shown in dotted line in FIG. 8. This position allows the rifle 12 to be installed in or removed from the display 10. However, when the actuating arm 80 is manually moved to the solid line position as seen in FIG. 8, the receiver securing shaft 78 pivots about axis 84 to cause the receiver securing arm 76 to pivot as well and extend outwardly passed the planar surface 36. If a rifle 12 is mounted on the display 10, this position of the receiver securing arm 76 will either contact the receiver 88 of the rifle 12 or be immediately above it. This will cause the rifle 12 to be secured on the display 10 from at least casual removal.

Figure 3:
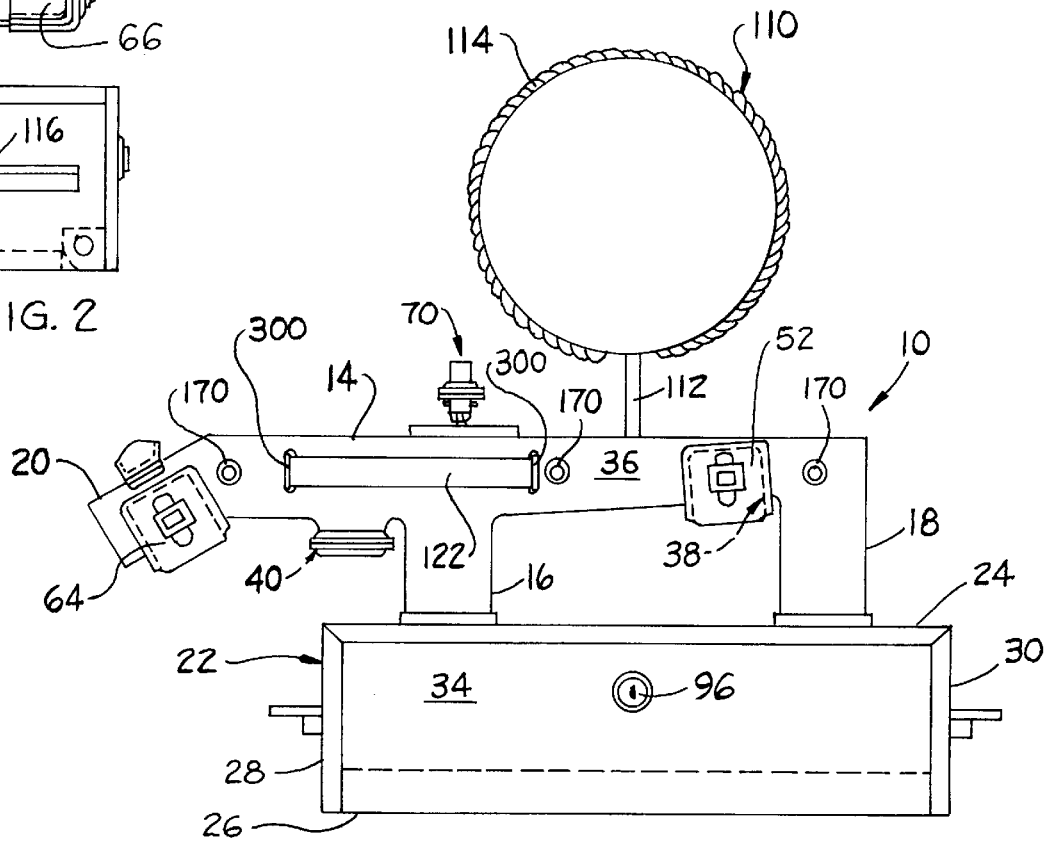
FIG. 3 is a front elevation view of the display.

The locking mechanism includes a block 90 having a U-shaped slot 92 formed therein. The arm 94 is secured to the block 90 for pivotal movement over the slot 92. To secure the rifle 12, the arm 94 is manipulated away from the slot 92 to allow the actuating arm 80 to be moved into the U slot 92. The arm 94 is then allowed to move over the U slot 92 to prevent the actuating arm 80 from moving from the solid line position as shown in FIG. 3. A lock 96 can be mounted on the door 34 to secure the door in the closed position to prevent access to the interior 86 of the box 22.

The stock securing shaft 74 is similarly mounted in the frame 14 for pivotal motion about a generally horizontal axis 98. The end opposite the stock securing arm 72 is provided with a cross member 100. The receiver securing shaft 78 has an extension 102 to which interferes with the cross member 100 when the receiver securing shaft 78 is pivoted to the securing position. More specifically, as seen in FIG. 8, when the stock securing arm 72 is in the solid line position, the cross member 100 extends generally horizontally. In this position, the extension 102 can be moved over the cross member 100 when the receiver securing shaft 78 is moved to the securing position to prevent the pivotal motion of the stock securing shaft 74 and movement of the stock securing arm 72 from the position shown in solid line. As shown, the stock securing arm 72, when in the solid line position in FIG. 8, cooperates with the support 42 to secure the rifle 12 on the display 10. When the receiver securing shaft 78 is pivoted to the releasing position by manipulating the actuating arm 80 to the releasing position shown in dotted line in FIG. 8, the extension 102 moves away from the cross member 100. This allows the stock securing arm 72 to be lifted manually to the releasing position, as shown in dotted line in FIG. 8, to remove the rifle 12 from the display 10 or place the rifle in the display 10.

Figure 7:
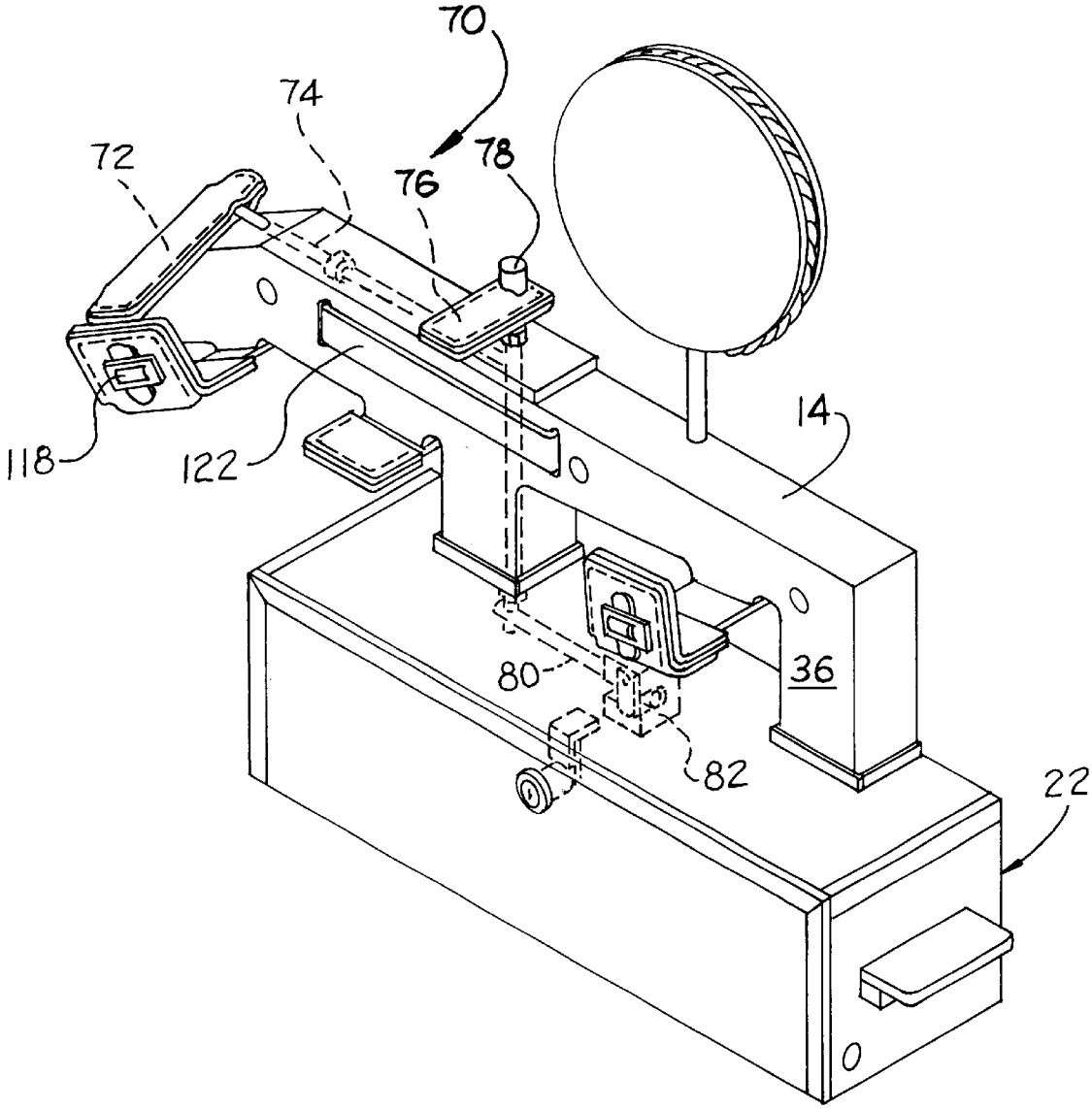
FIG. 7 is a perspective view of the display.

The stock securing shaft 74 is pivotally mounted in the frame 14 by forming a mortice into the back 152 of the frame 14 which intersects the cylindrical passage through the frame 14 which receives securing shaft 74. A metal collar 154 is placed in the mortice with the aperture in the collar aligned with the passage through the frame 14. The securing shaft 74 is inserted in the passage from the end of the frame 14 at extension 20. The cross member 100 would not yet be secured to the securing shaft 74 at this point. Once inserted, the cross member 100 can be welded or soldered at the inner end of the securing shaft 74. The collar 154 has a set screw therein which is accessible at the opening of the mortice when the securing shaft 74 is rotated about 180 degrees from the position shown in FIG. 7. The set screw is securely tightened to fix collar 154 to securing shaft 74 so that the shaft can only pivot about axis 98 but not move along the axis.

The receiver securing shaft 78 can be adjusted vertically to insure proper fit between the cross member 100 and the extension 102. The lower end 156 is threaded and receives a threaded nut 158 to adjust the vertical position of securing shaft 78. The lower end 156 passes through an aperture in the actuating arm 80. Passages are formed in both the lower end 156 and actuating arm 80, which are aligned when the lower end 156 passes through the aperture in the actuating arm 80 and receive a roll pin to secure the actuating arm 80 to the securing shaft 78.

Figure 10:
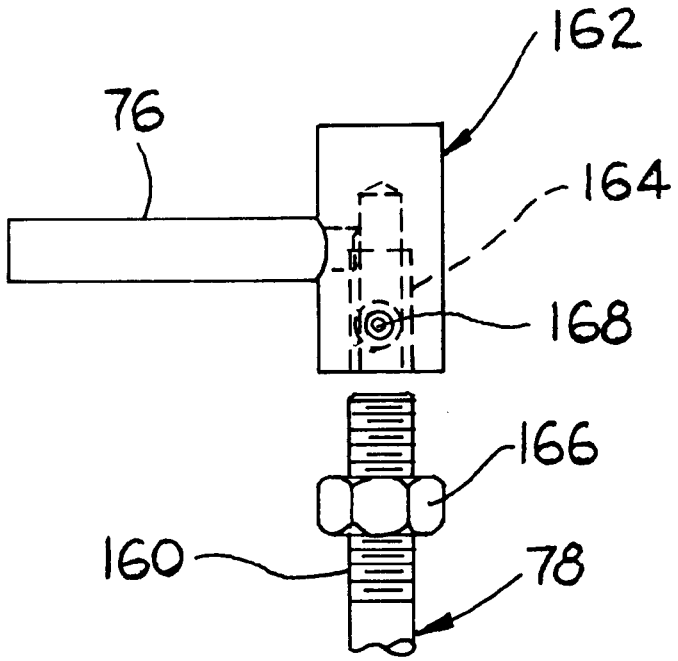
FIG. 10 is a detail view of the receiver securing shaft.

The position of the receiver securing arm 76 is also adjustable vertically relative the receiver securing shaft 78 to fit the display to the rifle. As best seen in FIG. 10, the upper end 160 of the securing shaft 78 is also threaded. A threaded cap 162 with an internal thread 164 is threaded onto the upper end 160. The securing arm 76 is attached to the cap 162. The cap 162 is simply rotated about the threads on the upper end 160 of the securing shaft 78 until the vertical position of the securing arm 76 is correct. As can be understood, the cap 162 must be rotated in increments of 360 degrees to insure the proper positioning of the securing arm 76 over the rifle, however, if the threads on the upper end 160 and thread 164 are of sufficiently fine pitch, a reasonable adjustment can be made. Once properly adjusted, a nut 166 threaded on the upper end 160 is tightened against the cap 162 and two set screws 168 threaded in cap 162 are tightened against the upper end 160. Preferably, the set screws 168 are tightened sufficiently to block the threads and prevent further adjustment of the cap 162.

A member 110 can be supported from the frame 14 by a shaft 112. The member 110 can form the backing for a logo or other artistic rendering of information regarding the object displayed. The member 110 can have trim 114, as shown in the figures, such as formed by rope, to provide a pleasing appearance.

Mounting holes 170 are formed through frame 14 and are countersunk in the planar surface 36. The holes receive mounting bolts to mount the display 10 on a wall, etc. It will be noted that the holes are directly behind the rifle 12 when it is mounted on the display. By securing the rifle 12 with the securing mechanism 70, one is also effectively blocking access to the mounting bolts, preventing the removal of the display and rifle from the wall or other surface on which it is mounted. The position of the mounting holes 170 also hides the mounting hardware once the rifle is mounted on the display for esthetic purposes.

To protect the rifle 12 or object displayed from harm, the supports 38, 40 and 42 and the securing arms 72 and 76 are preferably covered with a non marring material, such as leather 120. Also, non-marring material such as leather strip 122 can be secured on the frame 14, as shown. The ends of the leather strip 122 fit into slots formed in the frame 14. Wedges 300 are then pounded into the slots to secure the ends of the leather strip 122 in the slots. When using leather, metal buckles 118 can be mounted on the leather to present a theme similar to a leather rifle sling.

As can be seen, the display 10 provides an efficient, effective device to display an object such as a rifle 12. The display 10 provides a securing mechanism to secure the object from at least casual removal. The shape of the display 10 suggests the human form, with member 110 representing the head, the frame 14 representing the torso, the support 38 and support 42 representing arms and hands and the legs 16 and 18 representing human legs.

Although one embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit and scope of the invention.

What is claimed is:

1. An apparatus for displaying and securing an object from casual removal of the object, comprising:

a frame;

a first member extending from the frame defining a first support surface for the object;

a second member extending from the frame defining a second support surface for the object; and a securing member mounted to the frame for movement between a first releasing position and a second securing position, the securing member in the second securing position interacting with the first member to secure the object there between against casual removal.

2. The apparatus of claim 1 further having a box, the frame secured to the box, and an actuating arm positioned within the box to move the securing member between the first releasing position and the second securing position.

3. The apparatus of claim 2 wherein the box has a lid with a lock, the lock preventing access to the actuating arm.

4. The apparatus of claim 1 further comprising a third member extending from the frame defining a safety latch.

5. The apparatus of claim 1 further comprising a second securing member mounted to the frame for movement between a first releasing position and a second securing position, the second securing member in the second securing position interacting with the second member to secure the object there between against casual removal.

6. The apparatus of claim 1 further comprising a first securing member shaft pivotally mounted in the frame, the securing member secured at one end of the first securing shaft, the opposite end of the first securing member shaft having a crossmember thereon.

7. The apparatus of claim 5 further comprising a second securing member shaft pivotally mounted within the frame, the second securing member mounted at one end of the second securing member shaft, and an actuating arm, the actuating arm mounted on the opposite end of the second securing shaft.

8. The apparatus of claim 1 wherein the first, second and securing members are covered at least partially with a non-marring material.

9. The apparatus of claim 8 wherein the material is leather.

10. The apparatus of claim 2 wherein the box has handles.

11. The apparatus of claim 1 wherein the frame is an elongated rectangle having first and second legs and an extension.

12. The apparatus of claim 1 further comprising a member mounted to the frame to display an artistic image.

13. An apparatus for displaying and securing a rifle from casual removal of the rifle, comprising:

an elongated frame having a generally rectangular cross section, first and second legs and an extension;

a first support member removably secured to the frame and having a first portion extending generally perpendicular from a planer surface on the frame to support a portion of the rifle, the first support member having a second portion extending from the first portion generally parallel the planer surface, the first support member and the planer surface defining a U-shaped surface;

a safety block removably secured to the frame and having a first portion extending generally perpendicular from the planer surface on the frame to prevent a safety on the rifle from moving to an active state, a second support member removably secured to the frame and having a first portion extending generally perpendicular from the planer surface on the frame to support a portion of the rifle, the second support member having a second portion extending from the first portion generally parallel the planer surface, the first support member and the planer surface defining a U-shaped surface;

a first securing arm mounted on the frame for pivotal motion between a first releasing position and a second securing position, the first securing arm in the second securing position interacting with the support members to secure the rifle there between against casual removal;

a second securing arm mounted on the frame for pivotal motion between a first releasing position and a second securing position, the second securing arm in the second securing position interacting with the support members to secure tile rifle there between against casual removal;

an enclosed structure, the first and second legs of the frame mounted to the enclosed structure, the enclosed structure having an interior and a lid with a lock thereon, the lock preventing access to the interior when activated;

an actuation arm mounted within the enclosed structure for movement between a first releasing position and a second securing position, the actuation arm connected to the second securing arm so that movement of the actuation arm to the first releasing position moves the second securing arm to the releasing position and movement of the actuation arm to the second securing position moves the second securing arm to the second securing position, the actuating arm preventing the first securing arm from moving out of the second securing position when the actuation arm is in the second securing position;

a locking mechanism in the interior of the enclosed structure to hold the actuation arm in the second securing position, the actuation arm being inaccessible when the lock on the lid is activated;

the support members and securing arms being at least partially covered by a non-marring material.

14. The apparatus of claim 13 wherein the material is leather.

15. An apparatus for displaying and securing an object from casual removal of the object, comprising:

a frame;

a first member extending from the frame defining a first support surface for the object;

a second member extending from the frame defining a second support surface for the object; and a securing member mounted to the frame for movement between a first releasing position and a second securing position, the securing member in the second securing position interacting with the first member to secure the object there between against casual removal, the securing member in the second securing position being spaced along the object from the first and second members.

16. The apparatus of claim 1 wherein the object is a rifle with a receiver, said securing member in the second securing position being proximate the receiver.

17. The apparatus of claim 16 wherein the securing member either contacts the receiver or is immediately above it in the second securing position.

18. The apparatus of claim 16 wherein the apparatus has an adjusting mechanism to vary the position of the securing member relative the receiver in the second securing position to fit the apparatus to the rifle.

19. The apparatus of claim 1 wherein the apparatus is secured to a generally vertical surface, the frame having at least one aperture to receive a fastener securing the apparatus to the surface, the object covering the first end of the aperture when the object is secured to the apparatus.

20. The apparatus of claim 1 wherein the securing member extends over a portion of the object in the second securing position to prevent removal of the object from contact with the first and second members, the securing member extending parallel the object in the first releasing position.

* * * * *